United States Patent [19]

Hashimoto et al.

[11] Patent Number: 4,814,115

[45] Date of Patent: Mar. 21, 1989

[54] SLIDE AND PIN TYPE CARBURETOR

[75] Inventors: Shogo Hashimoto; Hitoshi Watanabe, both of Odawara, Japan

[73] Assignee: Mikuni Kogyo Kabushiki Kaisha, Japan

[21] Appl. No.: 121,847

[22] Filed: Nov. 17, 1987

[30] Foreign Application Priority Data

Nov. 20, 1986 [JP] Japan ..... 61-177445[U]

[51] Int. Cl.[4] ..... F02M 9/06

[52] U.S. Cl. ..... 261/44.3

[58] Field of Search ..... 261/44.3, 44.4

[56] References Cited

U.S. PATENT DOCUMENTS

| | | | |
|---|---|---|---|
| 1,975,432 | 10/1934 | Piat | 261/44.3 |
| 2,987,304 | 6/1961 | Roy | 261/44.3 |
| 4,013,741 | 3/1977 | Edmonston | 261/44.3 |
| 4,442,046 | 4/1984 | Edmonston | 261/44.3 |

FOREIGN PATENT DOCUMENTS

| | | | |
|---|---|---|---|
| 60668 | 4/1913 | Austria | 261/44.4 |
| 59-173541 | 1/1984 | Japan | 261/44.4 |
| 59-101569 | 12/1984 | Japan | 261/44.4 |
| 60-101263 | 5/1985 | Japan | 261/44.4 |
| 60-153459 | 12/1985 | Japan | 261/44.4 |
| 61-81565 | 5/1986 | Japan | 261/44.3 |

*Primary Examiner*—Tim Miles

*Attorney, Agent, or Firm*—Lalos & Keegan

[57] ABSTRACT

A slide and pin type carburetor using a plate-shaped slide valve in which the lower end surface of a flat plate portion is placed on the same plane as that of a column-shaped portion, the flow rate of air is controlled in the periphery of the column-shaped portion within the region in which the column-shaped portion exists and in front of the flat plate portion within the region in which no column-shaped portion exists, and a cutaway is formed, ranging from the surface located on the upstream side of the lower end of the flat plate portion to the bottom surface of the column-shaped portion, toward the downstream side, in order to make it possible to set properly the level of a negative pressure to be produced without raising abnormally the negative pressure produced in the vicinity of the exit of a main fuel nozzle and to increase the flow velocity of air, without producing any turbulence, in the vicinity of the exit of the main fuel nozzle so that the atomization of the fuel is favorably performed. The cutaway has an inclined surface descending from the upstream side toward the downstream side to shape a part of a conical surface directed to a fuel metering needle mounted on the bottom surface of the column-shaped portion.

4 Claims, 3 Drawing Sheets

SLIDE AND PIN TYPE CARBURETOR

BACKGROUND OF THE INVENTION (a) Field of the Invention

The present invention relates to carburetor constructions, and more particularly to an improvement of a slide and pin type carburetor in which a slide valve for controlling the flow rate of suction air flowing through a main intake passageway by moving in a direction transverse to the main intake passageway comprises; a flat plate portion located on the upstream side of a main fuel nozzle opened to the main intake passageway and sliding along guide grooves formed on opposite sides of the main intake passageway; and a column-shaped portion, formed integral with the flat plate portion on the downstream side thereof, having a fuel metering needle fitted into the main fuel nozzle to form an annular fuel passageway.

(b) Description of the prior art:

The carburetor of the type, which has been known in the past, is shown in FIGS. 1 and 2 as an example. In FIGS. 1 and 2, reference numeral 1 denotes a carburetor body having a main intake passageway 3, through which suction air flows in the direction indicated by an arrow 3. Reference numeral 4 denotes a slide valve, which comprises guide grooves 5 formed on opposite sides of the main intake passageway 2, a flat plate portion 6 fitted into the guide grooves 5 to slide along the grooves, and a column-shaped portion 7 formed integral with the flat plate portion 6 on the downstream side thereof, on the bottom of which a fuel metering needle or pin 8 is mounted. The fuel metering needle 8 is fitted into a main fuel nozzle (not shown) opened to the main intake passageway 2 and formed an annular fuel passageway. This slide valve type carburetor controls the flow rate of air in accordance with the extent of the advance of the flat plate portion 6 of the plate-shaped slide valve 4 into the main intake passageway 2, so that, when the valve is fully closed, that is, in a state that the main intake passageway 2 is completely blocked by the flat plate portion 6, a negative pressure or a vacuum acting for the exit of the main fuel nozzle will become too high followed by the suction of an excessive amount of fuel and it has been difficult to control the flow rate of fuel through the annular fuel passageway formed by the main fuel nozzle and the fuel metering needle 8. The use of the carburetor having the slide valve of such a structure, therefore, has been limited to a particular field such as racing cars.

FIG. 3 shows the plate-shaped slide valve 4 forming a cutaway 9 at the center of the lower end of the flat plate portion 6 of the above-mentioned plate-shaped slide valve 4 and FIGS. 4 and 5 are structural views of the slide and pin type carburetor disclosed in U.S. Pat. No. 4,013,741, in which the plate-shaped slide valve 4 shown in FIG. 3 is used. That is to say, in FIGS. 4 and 5, reference number 1 represents a carburetor body, 2 represents a main intake passageway through which air flows in the direction of an arrow 3, and 4 represents a plate-shaped slide valve which comprises a flat plate portion 6 sliding along guide grooves 5 and a column-shaped portion 7, in which a cutaway 9 is formed at the center of the lower end of the flat plate portion 6 and a fuel metering needle 8 is mounted in the column-shaped portion 7 and is fitted into a main fuel nozzle 10 opened to the main intake passageway 2 to form an annular fuel passageway. These aspects are the same as in the slide and pin type carburetor shown in FIG. 2. The provision of the cutaway 9 can prevents an abnormally high vacuum from being produced around the exit of the main fuel nozzle 10 at a fully closed position of the plate-shaped slide valve 4. However, there is no difference between them in that the control of the flow rate of suction air is performed on the upstream side of the main fuel nozzle 10, and a static negative pressure is largely produced, due to a choke action, around the exit of the main fuel nozzle 10, so that the negative pressure brought about around the exit of the main fuel nozzle 10 cannot freely be set even through the cutaway 9 is provided.

SUMMARY OF THE INVENTION

A primary object of the present invention is to provide a slide and pin type carburetor provided with a prior art type of plate-shaped slide valve constructed as mentioned above, capable of setting properly the level of a negative pressure to be generated without raising abnormally the negative pressure around the exit the main fuel nozzle even when the valve is fully closed.

Another object of the present invention is to provide a slide and pin type carburetor capable of increasing flow velocity of air, without producing turbulence, in the vicinity of the exit of the main fuel nozzle.

Still another object of the present invention is to provide a slide and pine type carburetor capable of securing atomization of the fuel and corresponding finely to the requirements of an engine.

The slide and pin type carburetor according to the present invention is constructed so that the lower end surfaces of both the flat plate portion and the column-shaped portion of the plate-shaped slide valve are formed to be flush with each other and so that the flow rate of air is controlled in the periphery of the column-shaped portion within the region in which the column-shaped portion exists and in front of the flat portion within the region in which no column-shaped portion exists and a cutaway bringing about a preset negative pressure in the vicinity of the exit of the main fuel nozzle is formed, ranging from the surface located on the upstream side of the lower end of the flat plate portion to the bottom surface of the column-shaped portion, toward the downstream side.

According to the preferred formation of the present invention, an arch wall concentric with the opening of the main fuel nozzle stands upright, from the inside of the main intake passageway, around the exit of the main fuel nozzle on its upstream side, and on the bottom of the column-shaped portion of the plate-shaped slide valve is formed a recess capable of accommodating the preceding arch wall therein. The cutaway forms an arc cross section and has an inclined surface descending from the upstream side toward the downstream side, extending to the recess.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Figure 1:
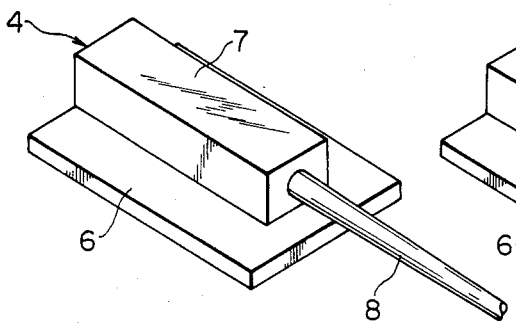
FIG. 1 PRIOR ART
FIG. 1 is a perspective view showing an example of a conventional plate-shaped slide valve.
Figure 3:
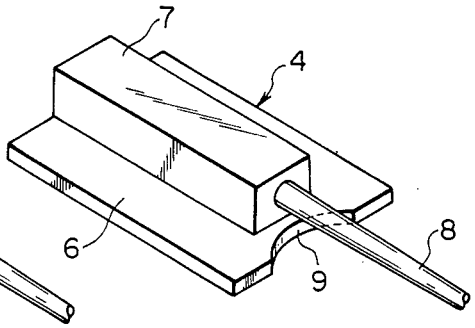
FIG. 3 PRIOR ART
FIG. 3 is a perspective view showing another example of the conventional plate-shaped slide valve.
Figure 2:
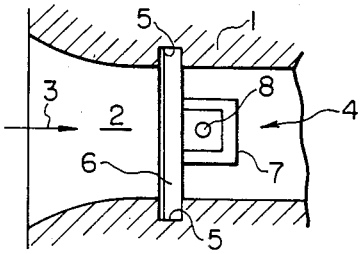
FIG. 2 PRIOR ART
FIG. 2 is a plan view showing a state of the installation of the plate-shaped slide valve shown in FIG. 1.
Figure 4:
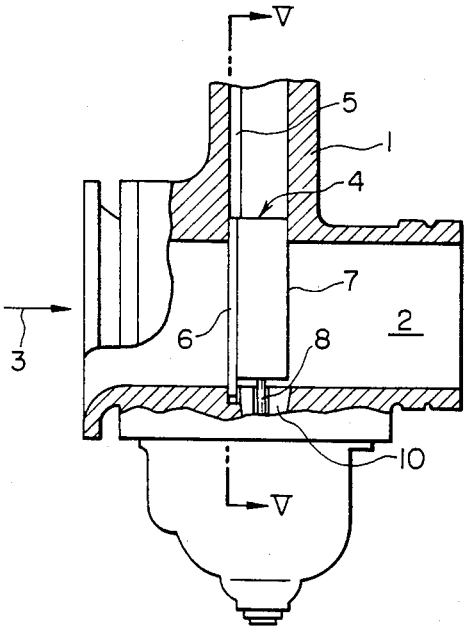
FIG. 4 PRIOR ART
FIG. 4 is a longitudinal sectional view of principal components of the carburetor using the plate-shaped slide valve shown in FIG. 3.
Figure 5:
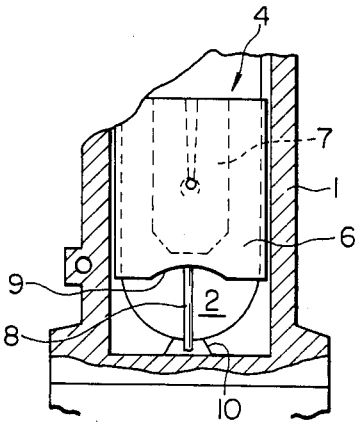
FIG. 5 PRIOR ART
FIG. 5 is a sectional view, taken along line V—V in FIG. 4, showing a state of a half-opened main intake passageway.
Figure 6:
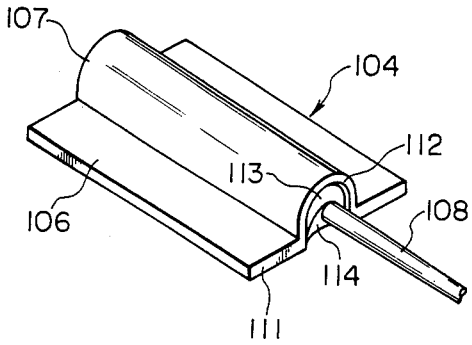
FIG. 6 is a perspective view of an embodiment of the plate-shaped slide valve according to the present invention.
Figure 7:
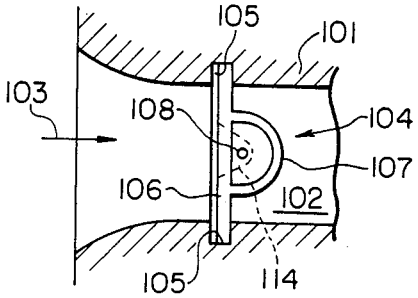
FIG. 7 is a plan view showing a state of the installation of the plate-shaped slide valve shown in FIG. 6.
Figure 8:
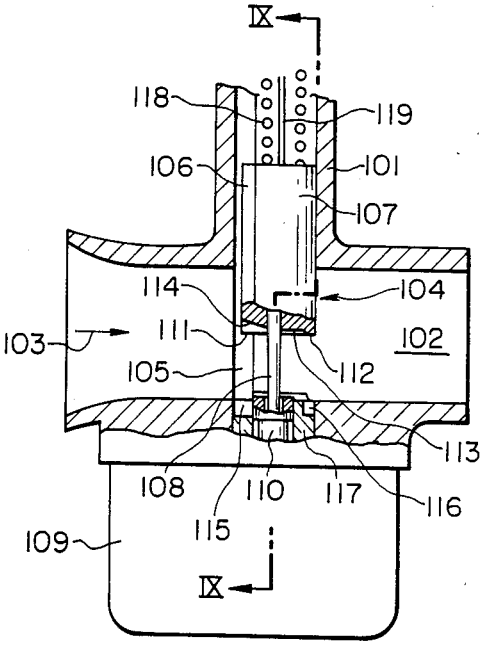
FIG. 8 is a longitudinal sectional view of principal components of the carburetor using the plate-shaped slide valve shown in FIG. 6, showing a state of a half-opened main intake passageway.
Figure 9:
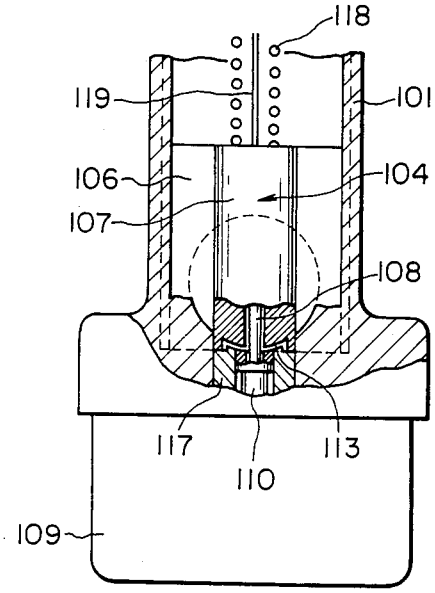
FIG. 9 is a sectional view, taken along line IX—IX in FIG. 8, showing a state of a fully closed main intake passageway.
Figure 10:
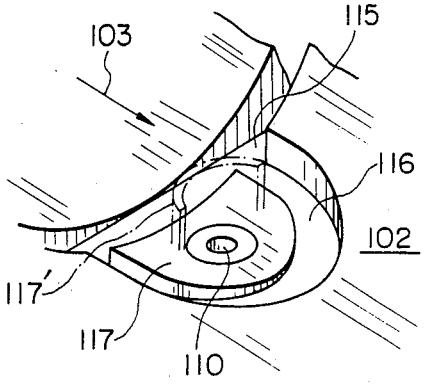
FIG. 10 is a perspective view of the inside portion of the main intake passageway mating with the lower end surface of the plate-shaped slide valve according to the present invention.

Referring to FIGS. 6 to 10, reference number 101 designates a carburetor body, 102 a main intake passageway, and 103 an arrow indicating a direction of the flow of suction air. Reference numeral 104 designates a slide valve (plate-shaped slide valve), functioning as a throttle valve, which comprises a flat plate portion 106 fitted into guide grooves 105 formed on opposite sides of the main intake passageway 102 to slide along the grooves and a column-shaped portion 107 formed integral with the flat plate portion 106 on the downstream side thereof, and the column-shaped portion 107 assumes the form of a substantially half-round hollow body with a bottom in cross section and is equipped with a fuel metering needle 108. The fuel metering needle 108 is fitted into a main fuel nozzle 110 introducing the fuel into the main intake passageway 102 from a float chamber 109 to form an annular fuel passageway between the main fuel nozzle 110 and the fuel metering needle 108. The plate-shaped slide valve 104 is defined so that a lower end surface 111 of the flat plate portion 106 is flush with a half-round lower end surface 112 of the column-shaped portion 107. Accordingly, by virtue of the half-round lower end surface 112 within the region in which the column-shaped portion 107 exists and by virtue of the lower end surface 111 of the flat plate portion 107 with in the region in which no column-shaped portion 107 exists, the control of the flow rate of suction air is carried out in association with the inner circumferential surface of the main intake passageway 102. A bottom surface 113 of the column-shaped portion 107 is provided in a position slightly inward lower than the half-round lower end surface 112 and on the bottom surface 113 is formed a cut-away 114 for producing the present negative pressure to the vicinity of the exit of the main fuel nozzle 110. The cut-away 114, like the cutaway 9 shown in FIG. 3, is such that the surface (on the upstream side) of the flat plate portion 106 is cut in an arc manner to extend toward the downstream side therefrom. In other words, the cutaway 14 is formed in a position lower than the bottom surface 113 in such a manner that is extends from the surface of the flat plate 106 and shapes a part of a conical surface whose apex is placed in the vicinity of the needle 108. The bottom surface 113 of the column-shaped portion 107 assumes the form corresponding to the inner circumferential surface of the main intake passageway 102 as clearly shown in FIG. 9. FIG. 10 shows minutely the configuration of the inner circumferential surface of the main intake passageway 102 mating with the lower end portion of the plate-shaped slide valve 104. That is to say, reference numeral 115 represents a groove portion connected with the guide grooves 105 and numeral 116 represents a guide groove corresponding to the lower end surface 112 of the column-shaped portion 107, which are designed so that, when the plate-shaped slide valve 104 is in a position to block completely the main intake passageway 102, the lower end surface 111 of the flat plate portion 106 is fitted into the groove 115 and the lower end surface 112 of the column-shaped portion 107 into the groove 116. The bottom surface 113 of the column-shaped portion 107 is formed in the form corresponding to an inner circumferential portion 117 of the main intake passageway 102 surrounded by the grooves 115 and 116 and, even when the plate-shaped slide valve 104 is in a position to block completely the main intake passageway 102, a proper space is held between the bottom surface 113 and the inner circumferential portion 117, as shown in FIG. 9, so that a negative pressure with a proper extent is produced around the exit of the main fuel nozzle in association with the cutaway 114. Also, the inner circumferential portion 117 is constructed as a jet block, independently of the carburetor body 110. Reference numeral 118 represents a spring pressing the plate-shaped slide valve 104 to the fully closed position and numeral 119 represents an accelerating wire connected to the plate-shaped slide valve 104 and capable of pulling up the slide valve 104 to a position of an adequate opening degree against the spring 118 through an operating measure not shown.

Next, the function of the above-mentioned slide and pin type carburetor will be explained. FIG. 9 shows the position of the plate-shaped slide valve 104 in the idling state. In such a state, the suction air flows in the direction of the arrow 103 after passing through the space between the cutaway 114 and bottom surface 113 of the column-shaped portion 107 and the inner circumferential portion 117 and, in the vicinity of the exit of the main fuel nozzle, a preset negative pressure with a certain level is generated, by which the fuel having the amount corresponding to the flow rate of air passing through the space is sucked through the annular fuel passageway formed between the main fuel nozzle 110 and the fuel metering needle 108 and consequently a mixture suitable for the idling is produced. When the slide valve 104 is pulled up properly against the spring 118 through the accelerating wire 119, by an operating measure not shown, for acceleration, the flow rate of air flowing through the main intake passageway 102 is increased and the fuel having the amount corresponding to the flow rate of air is sucked through the fuel passageway, with the result that the mixture necessary for the acceleration is secured.

In such a way, a proper mixture is generally produced in accordance with the opening degree of the slide valve 104 and, in particular, the slide and pin type carburetor according to the present invention has the following functional features:

(1) Due to a basic structure that the plate-shaped slide vale 104 in which the flat plate portion 106 is positioned on the upstream side of the exit of the main fuel nozzle 110 is employed, a high negative pressure is produced in the vicinity of the exit of the main fuel nozzle 110 when the valve is fully closed.

(2) In the region in which the column-shaped portion 107 of the plate-shaped slide valve 104 is located, the flow rate of air is controlled through the space between the lower end surface 112 of the column-shaped portion 107 and the corresponding inner circumferential portion 117 of the main intake passageway 102 and the cutaway 114 is formed on the bottom surface 113 of the flat plate portion 106 and the column-shaped portion 107 from the surface of the flat plate portion 106 located on the upstream side toward the downstream side, so that the generation of the negative pressure can arbitrarily be set in such a manner that the negative pressure generated in the vicinity of the exit of the main fuel nozzle 110 is decreased.

(3) By forming the bottom surface 113, in addition to the lower end surface 112 of the column-shaped portion 107 and the cutaway 114, to correspond to the inner configuration of the main intake passageway, the flow velocity of air is increased, without generating any turbulence, in the vicinity of the exit of the main fuel nozzle 110 even when the valve is fully closed, and the atomization of the fuel is favorably performed.

(4) The functions described in the above features (1) and (2) enlarges the range of the possibility that the carburetor is adapted to an engine, with the result that the carburetor can correspond finely to the requirements of the engine.

Figure 11:
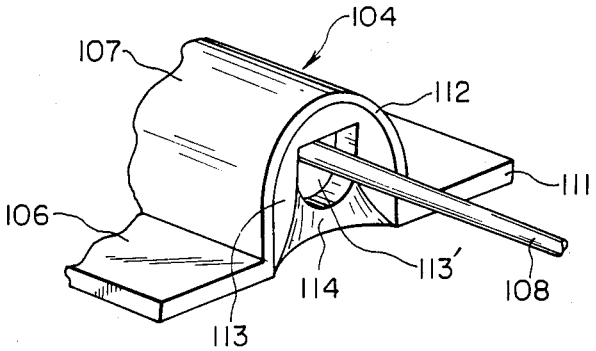
FIG. 11 is an enlarged perspective view of principal components showing another embodiment of the plate-shaped slide valve according to the present invention.
Figure 12:
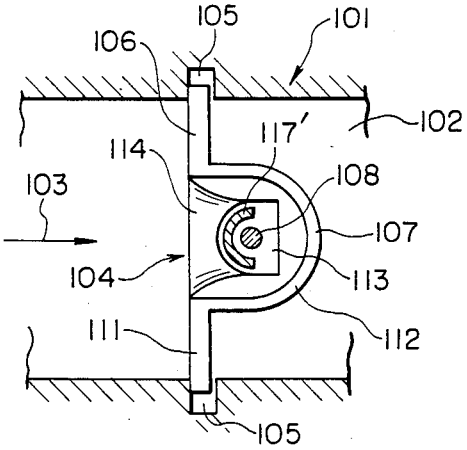
FIG. 12 is an enlarged view showing correlation between the lower end surface of the plate-shaped slide valve shown in FIG. 11 and the main fuel nozzle portion.

FIGS. 11 and 12 show another embodiment of the plate-shaped slide valve 104 according to the present invention. This embodiment is different from the preceding embodiment in that it is further formed with a deep square recess 113' having an arc concentric with the fuel metering needle 108 on the bottom surface 113 of the column-shaped portion 107, as clearly shown in FIG. 11, and a half-round projecting wall 117' formed concentric with the main fuel nozzle 110 on the upstream side thereof is constructed to be loosely accommodated into the recess 113' as clearly shown in FIG. 12. The projecting wall 117' is formed integral with the inner circumferential portion 117 as shown in chain lines in FIG. 10. According to this formation, the advantage mentioned in the preceding feature (3) can further be increased.

What is claimed is:

1. A slide and pin type carburetor, in which a slide valve being moved in a direction transverse to a main intake passageway and thereby controlling a flow rate of air flowing through said main intake passageway comprising a flat plate portion located on the upstream side of a main fuel nozzle opened to said main intake passageway and sliding along guide grooves formed on opposite sides of the main intake passageway, and a column-shaped portion having a fuel metering needle fitted into said main fuel nozzle to constitute an annular fuel passageway and formed integral with said flat plate portion on the downstream side of said flat plate portion so that a lower end surface of said flat plate portion of said plate-shaped slide valve is flush with that of said column-shaped portion; a cutaway for producing a preset negative pressure to the vicinity of an exit of said main fuel nozzle is formed on a bottom surface of said flat plate portion and said column-shaped portion, extending from the upstream side surface of said flat plate portion toward the downstream side; a straight groove, connected with said guide grooves, into which the lower end of said flat plate portion is fitted and an arcuate groove, connected with said straight groove, into which the lower end of said column-shaped portion is fitted are formed on the bottom surface of said main intake passageway; and a predetermined space is formed between the bottom surface of said flat plate portion and the bottom surface of said main intake passageway even when the lower end of said plate portion is fitted into said straight groove and the lower end of said column-shaped portion is fitted into said arcuate groove to block completely said main intake passageway.

2. A slide and pin type carburetor according to claim 1, wherein said column-shaped portion is constructed as a hollow body with a bottom wall assuming an arcuate form in cross section.

3. A slide and pin type carburetor according to claim 1, wherein said cutaway has an inclined surface descending from the upstream side toward the downstream side to shape a part of a conical surface.

4. A slide and pin type carburetor according to claim 1, further including an arcuate wall, and wherein on the bottom surface of said column-shaped portion is formed a recess capable of accommodating said arcuate wall projecting concentric with the exit of said main fuel nozzle in the vicinity of the upstream side of said main fuel nozzle and said cutaway is connected to said recess.

* * * * *